US005634295A

United States Patent [19]

Bunzl

[11] Patent Number: 5,634,295

[45] Date of Patent: Jun. 3, 1997

[54] REVOLVING DOOR

[75] Inventor: Helmut H. Bunzl, Zumikon, Switzerland

[73] Assignee: Record Turautomation GmbH, Wuppertal, Germany

[21] Appl. No.: 513,786

[22] PCT Filed: Mar. 25, 1994

[86] PCT No.: PCT/EP94/00955

§ 371 Date: Oct. 20, 1995

§ 102(e) Date: Oct. 20, 1995

[87] PCT Pub. No.: WO94/23167

PCT Pub. Date: Oct. 13, 1994

[30] Foreign Application Priority Data

Mar. 30, 1993 [DE] Germany ..... 43 10 295.6

[51] Int. Cl.[6] ..... E05D 15/02

[52] U.S. Cl. ..... 49/45; 49/44

[58] Field of Search ..... 49/44, 45

[56] References Cited

U.S. PATENT DOCUMENTS

| | | | |
|---|---|---|---|
| 798,786 | 3/1905 | Hansen | 49/44 |
| 1,202,801 | 6/1916 | Carter . | |
| 1,417,372 | 4/1922 | Friedland . | |
| 2,029,914 | 2/1936 | Dreher | 49/44 X |
| 3,285,209 | 11/1966 | Pace . | |
| 4,843,761 | 7/1989 | Sandling | 49/44 X |

FOREIGN PATENT DOCUMENTS

| | | |
|---|---|---|
| 0 428 196 A1 | 5/1991 | European Pat. Off. . |
| WO93/21416 | 3/1993 | European Pat. Off. . |
| 0 606 183 A1 | 1/1994 | European Pat. Off. . |
| 161780 | 11/1903 | Germany . |
| 179056 | 12/1904 | Germany . |
| 217165 | 3/1907 | Germany . |
| 223939 | 6/1908 | Germany . |
| 164248 | 11/1918 | Germany . |
| 0 296 134 A1 | 12/1988 | Germany . |
| 0 296 134 B1 | 10/1990 | Germany . |
| 167013 | 8/1921 | United Kingdom . |
| 187740 | 11/1922 | United Kingdom . |
| 2 131 073 | 6/1984 | United Kingdom . |

OTHER PUBLICATIONS

"Besam KD–4" prospectus.

*Primary Examiner*—Kenneth J. Dorner
*Assistant Examiner*—Jerry Redman
*Attorney, Agent, or Firm*—Nixon & Vanderhye

[57] ABSTRACT

Revolving door having at least four variable length door wings extending radially into a passageway, and being offset from one another in the direction of rotation about a central axis. Each door wing includes at least two sliding door elements slidingly movable relative to each other to vary the radial length of the door wings. Each door wing has a pivot axis disposed radially outwardly from the central axis. Adjacent door wings are pivotable about their respective pivot axes from an operating position in which the door wings extend radially into the passageway to an open position in which the sliding door elements slide relative to each other to shorten the radial length and unblock the passageway.

20 Claims, 5 Drawing Sheets

REVOLVING DOOR

The invention relates to a revolving door.

BACKGROUND OF THE INVENTION

Revolving or rotating doors are used as a particularly impressive, eye-catching embodiment for an entryway into a building. These revolving or rotating doors can be installed frontally, outside a facade wall, inside the wall, or in the middle of the wall.

They form a passageway with bow-shaped dram walls provided at the entry on the left and right of the entrance, between which a rotor revolves.

One revolving door of this generic type has been disclosed by British Patent BR-A 187 740. This revolving door includes four door wings offset circumferentially by 90°. In the usual operating position, all four door wings are aligned radially, so that the door wings each come to rest opposite their pivot axis in the region of the central axis or axis of symmetry that is free of rotational axis bodies and that penetrates the passageway. In order to unblock the passageway as generously as possible, for instance in the event of danger, two door wings can be pivoted in pairs toward one another and thus toward the lateral outer walls of the passage that define the passageway.

U.S. Pat. No. 1,202,801 discloses a largely similar revolving door. This previously known revolving door includes four door wings with external pivoting axes, which wings are disposed offset from one another by 90°. In order to be able to unblock the passageway in the event of an emergency, it is possible to pivot the individual door wings in succession in the direction of escape on their external pivot axes.

The object of the present invention, therefore, is to produce an improved revolving door.

SUMMARY OF THE INVENTION

The present invention creates an embodiment, which is highly attractive aesthetically as well, for unblocking a wide passageway in the event of panic or for transposing goods through the revolving door. It is in fact provided according to the invention that the door wings comprise sliding door elements. This offers the opportunity of shortening the effective length of the individual door wings by moving the sliding door elements toward one another when the door pivots outward to unblock the passageway. This also avoids having the door wings overlap when pivoted into the open position, as is the case in the prior art.

In principle, Geman Patents DE-PS 161 780 and DE-PS 164 248 have likewise disclosed a revolving door. These known revolving doors, though, address a completely different stated object. These disclosures, published prior to the filing date of the present application, provide that at the entry and exit respectively of the passageway embodied by the revolving door, the door wings can be folded around an external pivot axis into a closed position. In other words, the pivoting wings then act like normal swinging doors at the entry and exit of the revolving door passageway. To that end, each of the wing doors is divided in two. Each door wing is comprised of two articulatingly connected individual wings, which can be laid against each other. The shorter door wing section can be folded so that at the entry and exit of the passageway, these door wings can then be used as normal swinging doors. As a result, the passageway is closed off evenly by two pairs of swinging doors disposed one behind the other and is not unblocked and opened in accordance with the invention.

In a particularly preferred embodiment form of the invention, the respectively cooperating pairs of wing doors are coupled to each other and can be adjusted commonly between their open position and their operation which allows the normal operation of the revolving door.

In a particularly preferred embodiment form, the sliding door elements, which are disposed on the inside in the closed position, are each coupled to a cooperating pair of wing doors, for example articulatingly coupled. This reveals the possibility that both cooperating pairs can each be pivoted between their closed and open position via a single drive mechanism, which can is disposed preferably in the coupling region.

To increase stability, the ends of the door wings can be embodied in the central and symmetry axis region so that when the door wings are closed, their free ends at least interlock with one another and are therefore supported.

In a particularly preferred embodiment form, it is further provided that during a rotation of the revolving door, the outer sliding door elements, which are disposed offset toward the outside of the central or symmetry axis, follow a curved path, which is arbitrary over a wide range. In other words, during a rotation, the outer limiting edge of the sliding doors is correspondingly retracted and extended again in the radial direction, controlled in an automatic or targeted manner. As a result, the previously unforeseen possibility arises that the wing length as a whole can be altered during a rotation. The desired curved course of the outer edge of the pivoting door construction is thus achieved by means of a corresponding overlapping of the rotation movement of the wings with a corresponding radial retracting and extending motion of the pivoting door elements. As a result the surprising possibility arises of embodying a passageway which is embodied not as a cylinder, but as a straight extending passageway, for example.

It is equally possible, though, that based on this principle, the so-called shearing effect is prevented. To that end, namely in the preselected manner, the respective sliding door or doors of a wing are retracted inward until between the outer edge of the furthest out sliding door and the entry edge of the beginning passage limiting wall, there is a sufficiently large safety spacing for a partial rotation, which reduces to zero any danger of jamming.

Further advantages, details, and characteristics of the invention ensue below from the exemplary embodiment shown from the drawing. In particular,

DESCRIPTION OF PREFERRED EMBODIMENTS

Figure 1:
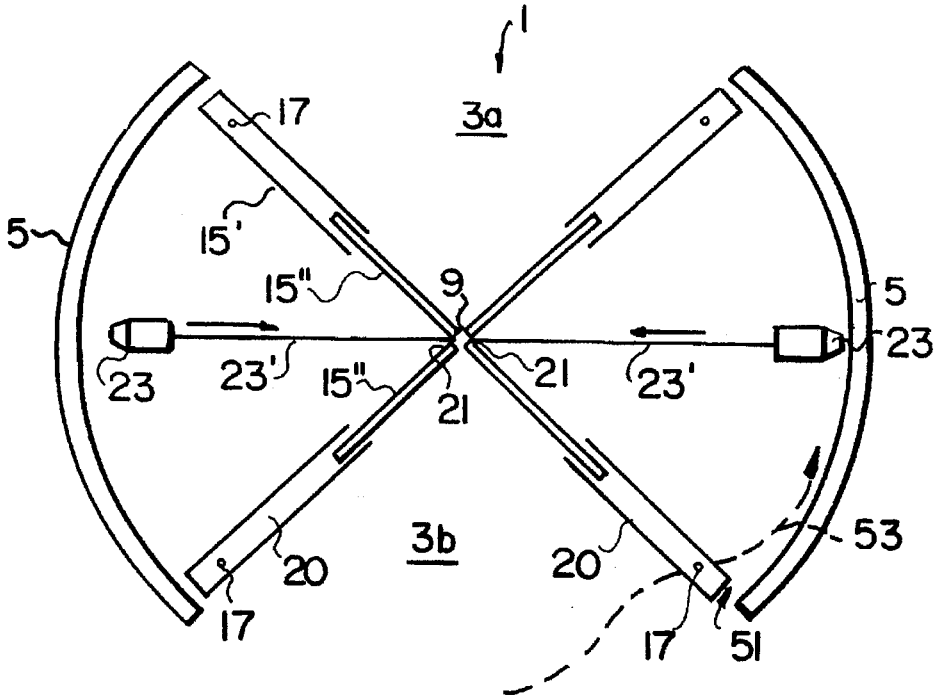
FIG. 1 shows a schematic top view of an exemplary embodiment of the revolving door according to the invention.

FIG. 1 shows a schematic top view of a first exemplary embodiment of a revolving door according to the invention.

The revolving door is installed in a passageway 1 forming two opposite entry openings 3*a* and 3*b* and in the exemplary embodiment shown has two lateral passage limiting walls 5, which are disposed offset by 180° and in the exemplary embodiment shown are embodied as dram walls, which are bow-shaped when viewed from above.

What is known per se and not depicted in the drawing is that for example at an entry opening 3*a*, which is disposed outside the housing, can be provided with door elements, which are shaped like partial arcs when viewed from the top, which are pivoted into their outward pivot position when the revolving door is unblocked and are pivoted toward each other in the closed position so that toward the outside, the actual entry opening 3*a* is closed in drumlike fashion.

In the exemplary embodiment shown, the revolving or rotating door shown includes a rotor or a rotor apparatus, which revolves around its central or symmetry axis 9, which runs perpendicular to the plane of the drawing. The rotor 7, though, is embodied as having no axis body in the region of the central or symmetry axis 9 to make possible a clear passageway.

Figure 2:
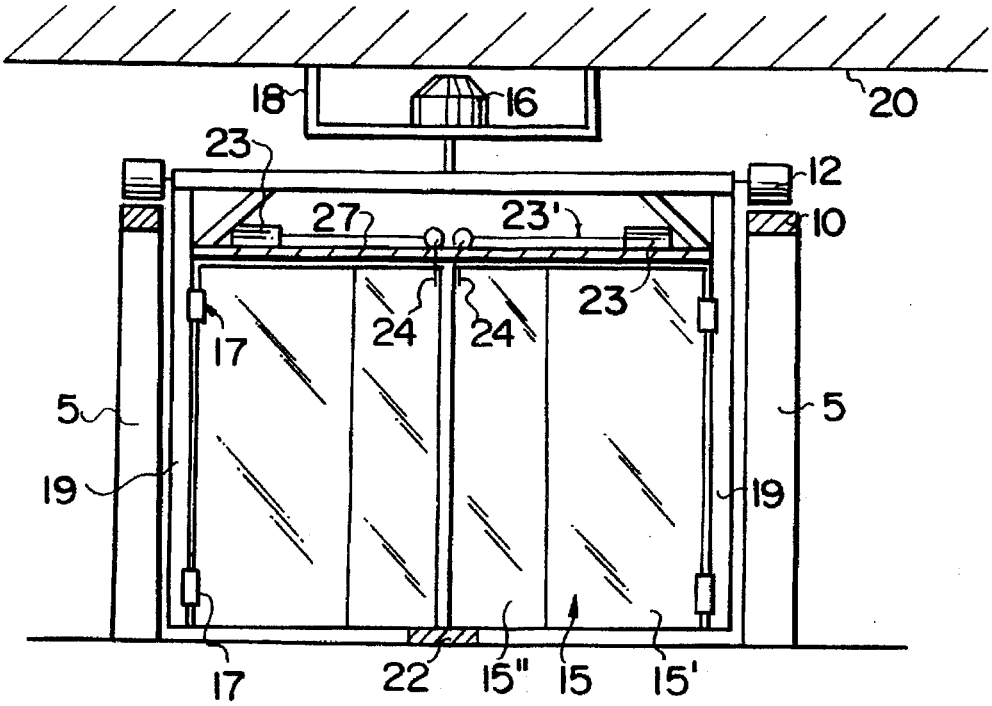
FIG. 2 shows a schematic vertical section through the central or symmetry axis, viewing two door wings in the closed state, which are disposed offset by 180°.

FIG. 2 describes a schematic, vertical, diagonal section depiction, leaving out a wing, which protrudes perpendicular to the plane of the drawing. It is obvious from this that on both passage limiting walls 5, resting on a circular path 10, which revolves above the entry opening 3*a* and 3*b*, for example a rotor cross 14, which is supported via rollers 12 and can be driven via a drive mechanism 16, is rotated in the operation of the revolving door. The drive unit 16 can be supported and secured to a ceiling 20 via a support structure 18 for example.

In the floor region for example—which is gone into further below—in the central, middle section, a support disk 22, which turns along with the wings, can be mounted in the floor so that it can rotate with them, and as a result the door wings are supported in the middle in their closed state.

In the exemplary embodiment, the rotating device of the revolving door, i.e. the rotor apparatus, includes four wings 15, which are disposed offset in the circumference direction by 90° and which are also described below as wing doors 15.

The wing doors 15 are each disposed so that they can pivot around an outer pivot axis 17. The pivot axis 17 can be embodied spaced apart slightly from the outer dram wall, with the rotor rotating along with a vertically extending door carder 19.

Finally, it is obvious from FIG. 1 that each of the wings or the wing doors 15 is embodied as a sliding door, which includes two sliding door elements 15' and 15", which can move relative to each other. The two sliding door elements 15' and 15" can be moved from their maximal longitudinal extension position, shown in FIG. 1, into a retracted position, shown in FIG. 3, which has a shorter overall length.

In the exemplary embodiment shown, each outer sliding door element 15', which can pivot around the pivot axis 17, is provided with an internal pocket-shaped receiving space 20, into and out of which the radially internal sliding door element 15" can be retracted and extended in telescope fashion.

Lastly, in the exemplary embodiment shown, the two respective radially inner sliding door elements 15" of a cooperating pair of wing doors 15 are connected or coupled to each other, for example by means of an articulated connection 21.

Figure 3:
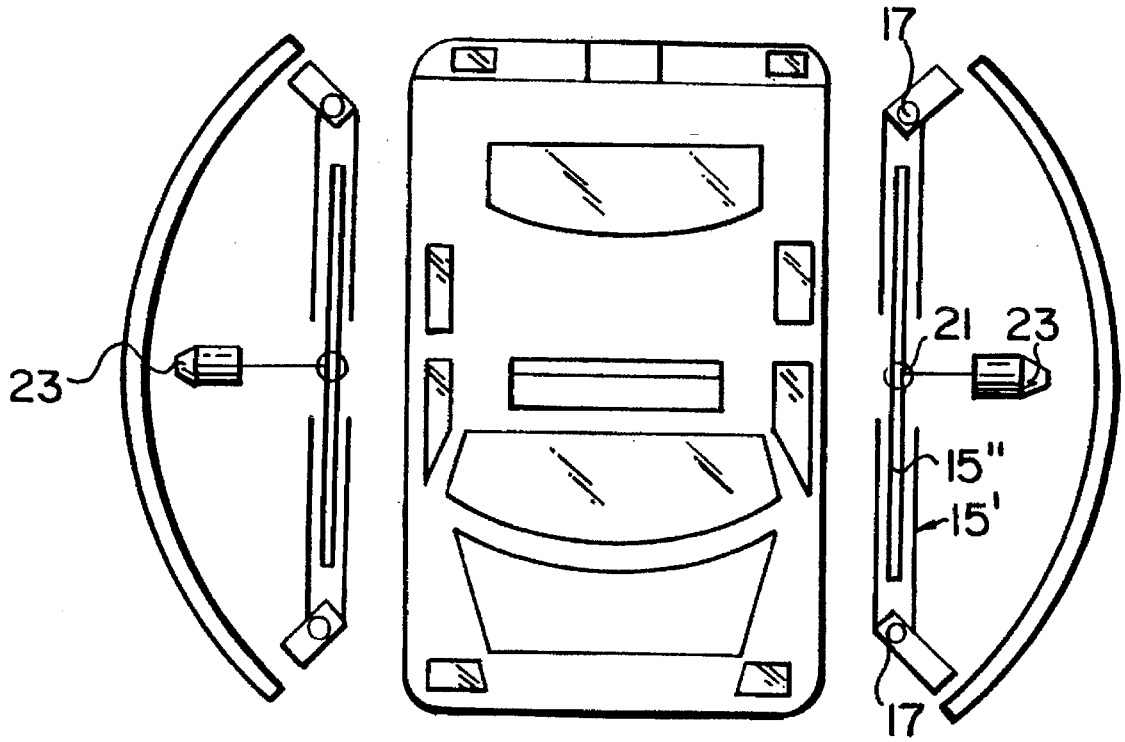
FIG. 3 shows a depiction corresponding to FIG. 1 of the revolving door in the open position.

As is obvious from FIGS. 1 and 3, a drive mechanism 23 for adjusting the wing doors can in particular engage on or be affixed at least indirectly to the articulated connection 21 or to another suitable place on at least one of the wing doors 15, which cooperate respectively in pairs. In the exemplary embodiment shown, this drive mechanism is disposed preferably in the direction of the angle bisecting line of two cooperating wing doors 15 and is mounted so that it can rotate along with the entire rotor apparatus and the wings. The drive and transmission mechanism or assembly 23' is thus disposed rotated by 45° from the door wings 15, which are aligned in a cross.

In standard use and operation, the wing doors 15 are disposed in their closed position shown in FIG. 1. Via the entry opening 3*a*, a passer-by can enter the open chamber pointing toward him in order to then cross through the passageway in a known manner in a continuously rotating chamber, for example in a revolving door which rotates counterclockwise.

If however, as is shown in FIG. 3, a transport of goods, for example, needs to be carded out through the revolving door, for example a new car needs to be driven into a showroom, when the revolving door is stationary, that is when the rotor is not rotating and thus the wing doors are not turning, the wing doors 15 are pivoted into their open position shown in FIG. 3. The pivoting is preferably carried out in the alignment position shown in FIG. 3, in which the two pivot axes 19 of two wing doors 15 each come to rest adjoining the entry openings 3*a*, 3*b* (FIG. 3).

Then for example, the pivoting doors 15, which are shown in FIG. 3 adjoining the left passage limiting wall 5, are pivoted toward each other by means of the drive mechanism 23, which can be switched on. At the same time, the outer wing door elements 15", which are coupled to each other and can move in the longitudinal direction of the wing doors 15, are retracted into the respective outer sliding door element 15'. By continuously shortening the overall length of both wing doors 15, which cooperate as a pair, the entire pivoting takes place until they reach the end position shown in FIG. 3, in which both wing doors 15, which cooperate as a pair, are preferably aligned in a flush plane to each other.

The adjusting process preferably takes place at the same time as and correspondingly with regard to the two cooperating wing doors 15 disposed on the fight in FIGS. 1 and 3.

As a result, in the final open position, the clear passageway shown in FIG. 3 is produced. The two wing doors 15, which adjoin the left passage limiting wall 5 come to rest parallel to the two wing doors 15, which adjoin the fight passage limiting wall 5, which produces a straight passageway.

It is noted only for the sake of completeness that the wing doors can naturally be pivoted toward the outer passage limiting walls 5 still further than is shown in FIG. 3. However, since the narrowest passage is defined by the space between two pivot axes 17 or the pivot projections 19 adjoining the entry openings 3*a* or 3*b*, only the middle passage region would be enlarged by means of this, which is not absolutely necessary.

In FIG. 2, it is only schematically depicted that the drive mechanism 23 and the transmission device or the drive assembly 23' can be mounted disposed above a revolving door cover 27. The revolving door cover 27 is disposed immediately above the upper limit of the door wings 15 and rotates along with the entire rotor apparatus. This revolving door cover 27 can simultaneously also be used as another supporting and carrying device for the door wings 15. In FIG. 2, it is only schematically depicted that also in the region of the end of the door wings opposite the pivot axis 17, in the region of the upper revolving door cover 27, an additional guiding and supporting function can also be provided (in FIG. 2, for example, by a guide roller, which engages a groove, not shown, in the revolving door cover), via which the pivoting movement of the revolving door from the normal operating position shown in FIG. 1 into the open position shown in FIG. 3 can be carried out by exerting supporting and carrying forces. For example a longitudinal slot or a longitudinal joint can be provided in the revolving door cover 27 along and for example beneath the transmission and drive mechanism 23', by means of which slot or joint a slaving catch or transmission bolt 24 (FIG. 2) protrudes downward from the drive mechanisms, which catch or bolt is connected to the door wing, preferably in the inner region (in FIG. 2, the catch bolt 24 engages on the inner end region of the inner sliding door element 15'). Then the two respective cooperating wing doors are pivoted into their open position by the radial, outward travel of the catch 24. As a result, it is also obvious that the radial joint mentioned, which is penetrated by the catch bolt 24, should extend radially outward at least until it reaches a straight lin that connects the respective pivot axes 17 of the cooperating wing doors. By actuating the drive mechanism in the reverse direction, the door wings are returned to their normal operating position.

The slaving connection can for example be carried out via the drive mechanism 23 in such a way that a belt, which turns along the route 23 (transmission device 23), is used; the catch bolt is fastened respectively to a drum of the belt. Depending upon the direction of movement of the drive belt in the open or closed position, the adjusting movement of the doors is carried out into the closed or open position, depending on the alterative feed motion of the belt.

Figure 4:
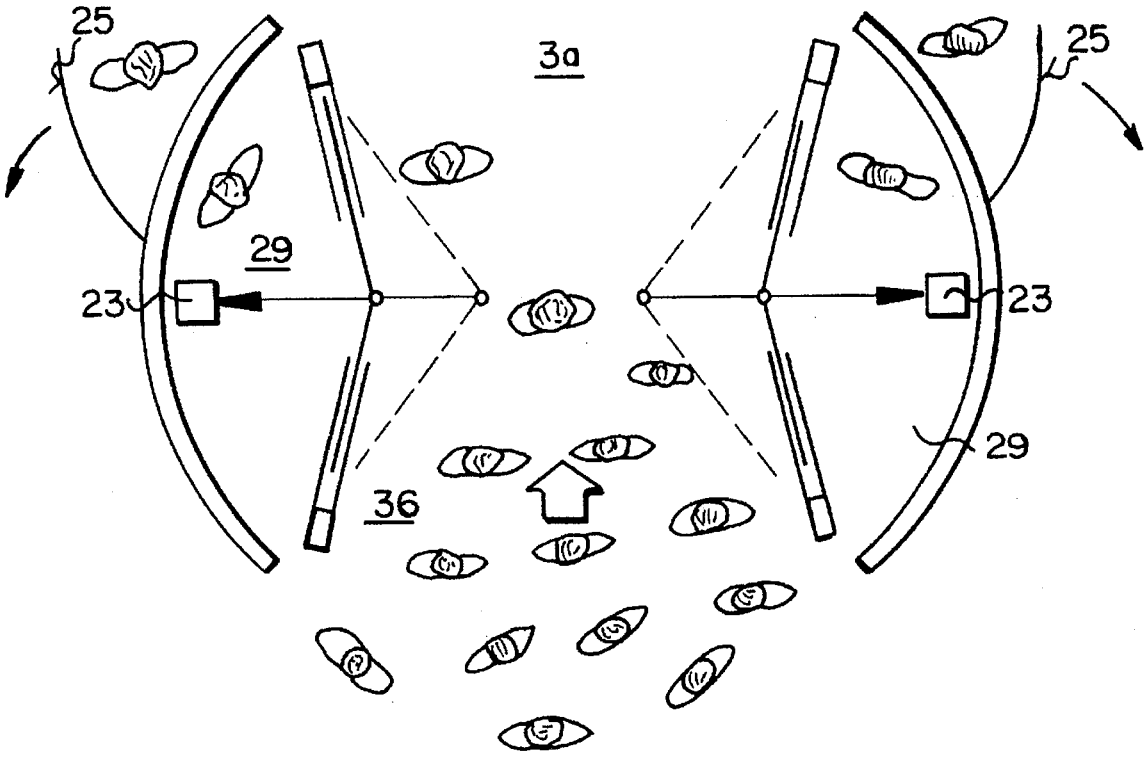
FIG. 4 shows a further depiction corresponding to the above depictions for the manner of function in the event of an emergency.

The described revolving door can also be used equally advantageously in the event of an emergency, as is described from FIG. 4.

For example in the event of an emergency, if a large number of people should need to escape from the inside of the building to the outside via the entry opening **3*b*, then in a corresponding normal positioning of the revolving door, the wing doors 15, which cooperate in pairs, are pivoted once again into the open position shown in FIG. 3**.

If there are still people in the respective chambers 29 running adjacent to the passage limiting walls 5, then an additional escape door 25 is provided in the passage limiting wall, which can be opened from the inside at any time, in order to exit this otherwise closed chamber.

Diverging from the exemplary embodiment shown, wing doors 15 can be embodied not only with two, but also if need be with three sliding door elements, which can move relative to one another in their longitudinal direction.

As is revealed from the previous description alone, after the motorized change-over of the door wings into the open position, they are also fixed in their open position according to FIG. 3 by the motorized drive mechanism. This incidentally reveals the possibility that with a further rotation movement of 90° with regard to the depiction in FIG. 3, e.g. generally in a position rotated 90° from FIG. 3, the door wings, which are pivoted toward each other into a plane and preferably are disposed flush to one another, come to rest with the correspondingly retracted sliding door wing elements each perpendicular to the entry openings **3*a* and 3*b*. In this way, both of the entryways 3*a* and 3*b* are closed firmly. In particular when the motorized drive mechanisms 23** are blocked, the passage as a whole can be closed and bolted, in the doubled sense in fact, by the two door wing pairs closed behind one another. Additional bolting measures are naturally also possible.

In order to produce a particularly favorable function mechanism, it can furthermore be provided that in the middle of the passageway a further support disk 22 is provided, which rotates in slaved fashion, as revealed in particular in the vertical section depiction according to FIG. 2. This support disk 16 can have 90° angle recesses, which are offset to each other by 180°, by means of which a slight step shoulder of for example only 1 cm is formed, against which the wing doors 15 abuttingly contact in their closed, cross-like position by their lateral adjusting region.

Figure 5:
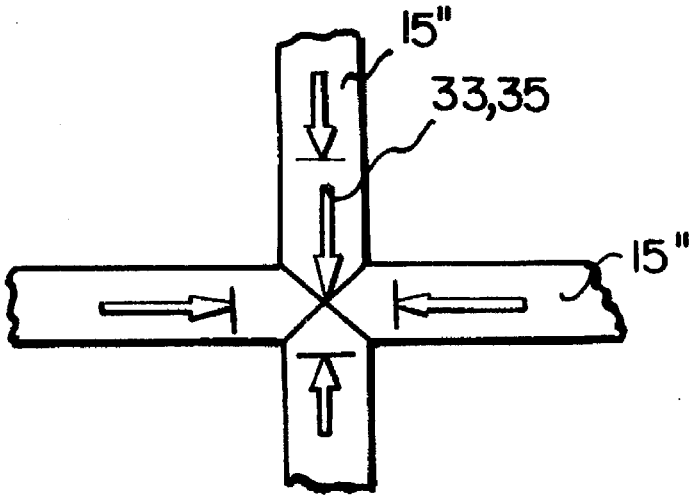
FIG. 5 shows a detailed depiction to explain a reciprocal anchoring and support function of the closed wing doors.

In a detail, FIG. 5 shows that the door wings 15 can be provided with a corresponding formation 33 or bolting device 35 disposed opposite from their pivot axes so that they are mutually supported and bolted in their cross-wise, bolted position (that is, in normal operation of a revolving door). This can be embodied according to the exemplary embodiment in FIG. 5 by means of a corresponding angular shape of the face edge. In the exemplary embodiment shown, the face edges are each embodied in the manner of a protruding, 90° sector so that the four related door wings in the exemplary embodiment shown are mutually supported on their face edges.

As a result, an additional centering is achieved for the ends of the wing doors 15 disposed in the region of the central or symmetry axis 9, which contributes to increasing stability.

Figure 6:
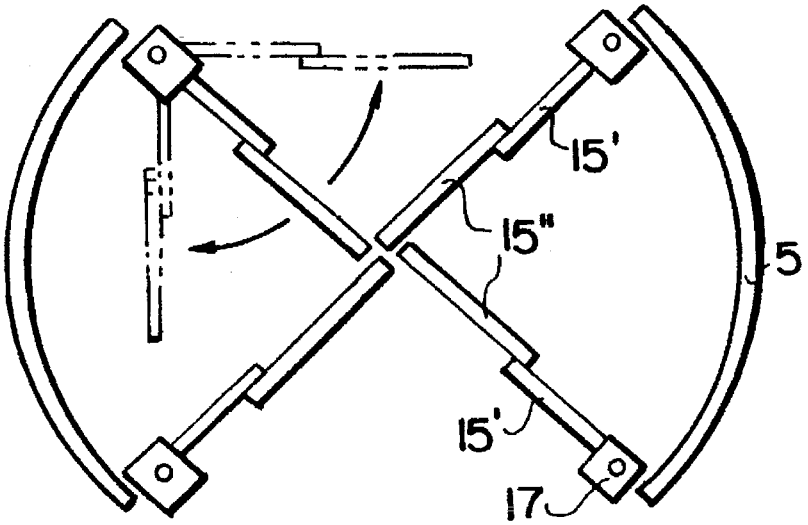
FIG. 6 shows a schematic top view of a further exemplary embodiment modified from FIG. 1.

Finally, only for the sake of completeness, FIG. 6 is referred to, in which four sliding door-like wings 15 are provided. As is obvious from the dashed line depiction, each door wing 15 can be pivoted not only in one direction, but also in the opposite direction. Therefore in this exemplary embodiment, there is no firm association with a respective second door wing since even in a position of the revolving door, which is rotated 90° further than FIG. 6, each door wing can be pivoted either to the left or fight so that it comes to rest adjoining the adjacent passage limiting wall 5. Also in this embodiment form, the inner ends of the wing door elements 15", though, can each be equipped so that they can be coupled with a second, positionally correctly associated wing door element to produce a secure and common pivoting motion so that at least the respective pivot movement into the open position can be carried out jointly and in a coupled manner.

In the exemplary embodiment shown, the vertical pivot axes are provided as far outside as possible. Preferably the pivot axes are disposed at a minimum spacing of 70%, preferably 75%, 80%, 85%, 90%, or even 95% of the maximal possible radial length of the door wing 15, measured outward from the midpoint, i.e. from the central or symmetry axis 9. In the exemplary embodiment according to FIG. 1, this corresponds to the spacing from the central or symmetry axis to the drum-shaped passage limiting walls 5.

Below, FIGS. 7 and 8 will be taken into consideration, in which a modified exemplary embodiment is shown.

Figure 7:
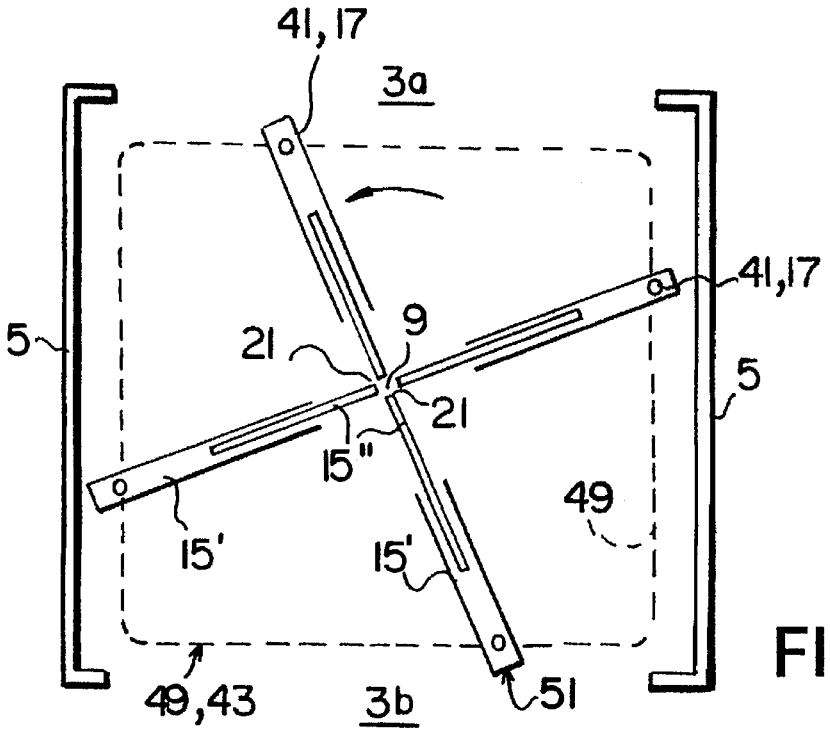
FIG. 7 shows a schematic top view of a modified exemplary embodiment.
Figure 8:
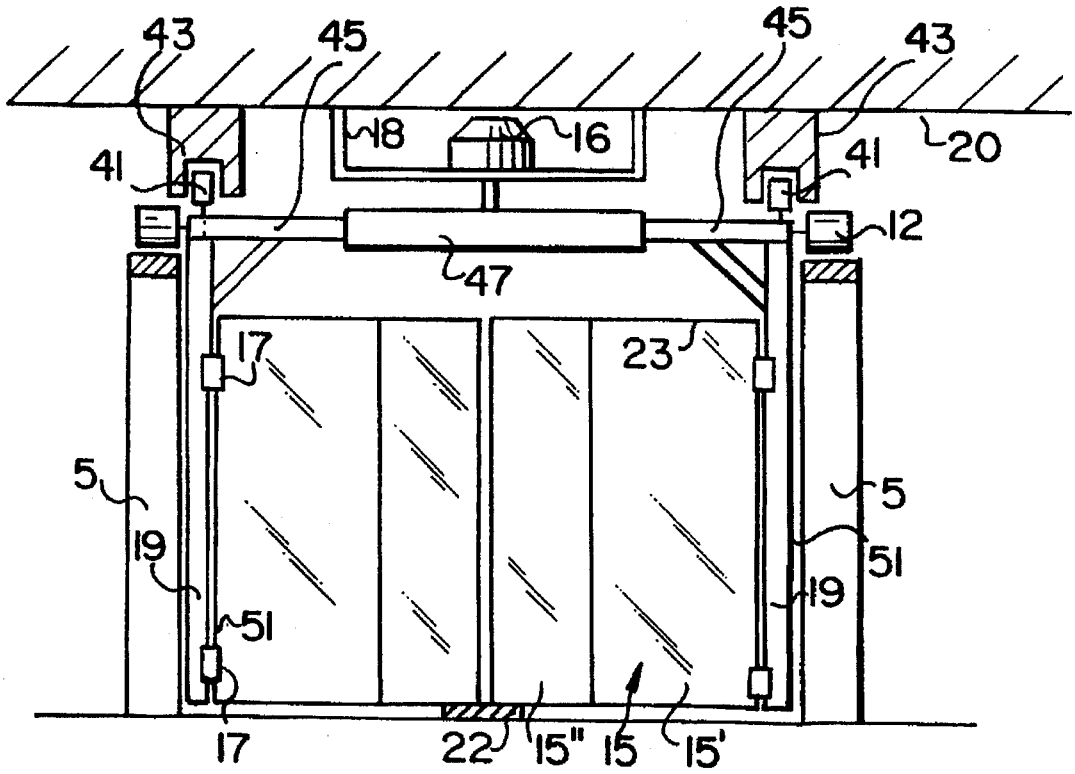
FIG. 8 shows front view, which is modified from FIG. 2 and corresponds to the exemplary embodiment according to FIG. 8.

The exemplary embodiment according to FIGS. 7 and 8 differs from the exemplary embodiment according to FIGS. 1 and 2 in that viewed from above, a circular passageway with cylindrical, lateral passage limiting walls 5 is not provided, but rather an essentially straight passageway.

The rotor apparatus explained intrinsically in terms of its principle in FIG. 1 and 2, by using a four winged arrangement without a rotor axis body, is of such a kind during a rotation that corresponds to the arrow depiction, the outer sliding door elements 15" are retracted and extended relative to the inner sliding door elements 15' so that the overall length of the wings 15 changes during a revolution.

In the exemplary embodiment shown according to FIGS. 7 and 8, the apparatus is of such a kind that above the vertical door carrier 19, a further guide roller 41 is respectively provided, which rotates around a vertical axis and is guided in a groove-shaped guide device 43 (which for example is embodied on and secured to the ceiling 20). Door carriers 19 have a gallows-shaped carrying structure, whose upper horizontal carrier 45, which is supported via the horizontal rollers 12, can be retracted and extended in telescope fashion in a telescoping guide 47 connected to the motor 16.

In the exemplary embodiment according to FIG. 8, the guide rollers 41, which engage in the guide device 43 and are equipped with a vertical axis, are disposed in the immediate vertical extension of the door carrier 19 or the pivot axis 17 embodied on it. The guide rollers 41 and the guide device 43, though, can also be disposed offset from it.

This embodiment reveals that in a rotation of the revolving door according to FIG. 7 by means of the correspondingly extending guide device 43, the guide rollers 41 and hence for example the pivot axis 17, which is flush with it when viewed from above, follow the guide path 49, which is shown in FIG. 7 with dashed lines. This means that during a rotation of the wings, the respective outer sliding door elements 15' are retracted and extended with regard to the inner sliding door elements 15" so that the overall width of the wings changes during a rotation. In the diagonal direction, the wing width (i.e. the wing length) assumes the greatest value, while in a position perpendicular to the passage limiting wall 5, which runs straight, the relative width of the door (i.e. its length) is at its lowest.

The guide path can naturally be arbitrary. It is quite possible to embody the passage limiting walls in undulating fashion. The guide device can also be correspondingly undulating, so that with the guide device explained, the effected retracting and extending movement of each outer sliding door element in relation to the respective inner one during a rotation can be more complex and can diverge from the exemplary embodiment according to FIG. 8.

For example, it is also possible that the sliding door elements in the entry and exit region 3*a*, 3*b* are guided so that they follow a circular path, and only follow each lateral passage limiting wall 5 when they are adjacent to it.

In the exemplary embodiment shown in FIG. 1, this kind of overlapping relative movements during a rotation of the revolving door for example also reveals the advantage that the risk of jamming (shearing) which exists in conventional revolving doors is prevented. This is because, as is depicted in FIG. 1 with dashed lines, each outer sliding door or outer sliding door element 15' can be retracted inward so that for example the outer edge 51 describes the curved path 53 shown in dashed lines in FIG. 1. In other words, for example at the beginning of the entry edge, a preselectable spacing of the outer edge 51 of the outer sliding door element 15" at for example 15–25 cm can be set in order to reliably prevent any shearing effect here at the beginning of the passage limiting wall 5. Upon continuous rotation of the revolving door, then the sliding door element 15" can be slid into its further outward position again, in which the outer edge 51 follows the passage limiting wall 5.

The exemplary embodiment explained from FIGS. 7 and 8 and the specific sliding of each outer sliding door element 15' in the region of the entry edge according to the dashed curved path 53 in FIG. 1 has been explained in terms of compulsory guidance using guide rollers 41, which engage in a guide device 43 and via this, control the retracting and extending movements of the respective outer sliding door elements 15'.

Diverging from this exemplary embodiment, a corresponding curved path course 53 in FIG. 1 or a guide path 49 in FIG. 7 can also be brought about by means of a separate control device not shown in the drawings, via which each individual wing or each pair of wings is separately retracted and extended or even, via compulsory guidance, a plurality of wings are jointly retracted and extended. That is, a drive mechanism is provided for the wings, which retracts and extends the outer sliding door element 15' in the radial direction during a rotation movement of the revolving door, depending on the desired curved path.

It is mentioned only for the sake of completeness that a further modification is also possible to the extent that the respective outer sliding door elements 15' are guided via a guide device to produce a rotation path that deviates from a normal circular path, with which device, though, the rotation movement of the wings is carried out supplementally or alone by means of a revolving drive belt or a drive mechanism similar to a drive belt. The drive belt is restrictively guided for example in a guide path 49 along a guide device 43. That is, the individual wings are coupled via the drive mechanism, which is similar to a drive belt, and are restrictively guided via it so that in turn, depending upon the guide path 49, the desired retracting and extending movement of each outer sliding door element with regard to the respective inner one can be carried out.

Also in the latter exemplary embodiment according to FIGS. 7 and 8 as well as the further explained modifications thereto, naturally the other pivoting mechanism for unblocking the passageway is likewise changed. That is, even in the exemplary embodiment according to FIGS. 7 and 8, for example preferably in the position of the wings which corresponds to FIG. 1, the respective pairs of wings adjacent to the limiting walls 5 are pivoted in opposite directions around their pivot axes 17 toward the limiting wall 5 so that the plane of the wings is disposed respectively parallel to the limiting wall 5. This produces a completely clear, unblocked passageway through the doorway.

I claim:

1. A revolving door, comprising:

a central axis of rotation;

at least four variable length door wings extending radially into a passageway, said door wings being offset from one another in a direction of rotation about said central axis, each door wing including at least two sliding door elements slidingly movable relative to each other to vary the radial length of said door wings, said door wings being positionable in an operating position in which said door wings extend radially into said passageway;

each door wing having a pivot axis disposed radially outwardly from said central axis, adjacent door wings being pivotable about their respective pivot axes from said operating position to an open position in which said sliding door elements slide relative to each other to shorten said radial length and unblock said passageway.

2. The revolving door according to claim 1, wherein adjacent door wings cooperate in pairs and are pivotable from said operating position to said open position towards passageway limiting walls defining said passageway.

3. The revolving door according to claim 2, and further including an escape door located in said limiting walls of said passageway.

4. The revolving door according to claim 1, wherein respective cooperating pairs of door wings are couplable to one another and are adjustable between their respective open and operating positions.

5. The revolving door according to claim 1, wherein radially innermost door elements of said door wings, in said operating position, cooperate as a pair and are coupled to each other.

6. The revolving door according to claim 5, wherein said radially innermost sliding door elements are connected at their ends which point towards said central axis of rotation during rotation of said door wings about said central axis.

7. The revolving door according to claim 1, and further including drive means connected to each door wing for causing movement between said operating and open positions.

8. The revolving door according to claim 1, and further including drive means connected to a pair of door wings for causing movement of said pair of door wings between said operating and open positions.

9. The revolving door according to claim 8, wherein said drive means includes drive transmission means extending along a line bisecting the angle between said pair of door wings for moving said pair of door wings between said operating and open positions.

10. The revolving door according to claim 1, wherein adjacent door wings in said open position are aligned with respect to each other.

11. The revolving door according to claim 1, wherein, in said open position, said sliding door elements retract with respect to each other to be substantially aligned with sliding door elements of the adjacent door wing.

12. The revolving door according to claim 1, wherein said pivot axes are disposed on opposite sides of said passageway such that said door wings in said open position are aligned parallel to each other.

13. The revolving door according to claim 1, and further including a support disk in said passageway, said said support disk rotating with said door wings about said central axis of rotation, said support disk supporting inner ends of said door wings in said operating position.

14. The revolving door according to claim 1, wherein an outer edge of said door wings is retractable and extendable during rotation about said central axis.

15. The revolving door according to claim 14, wherein said outer edge describes a curved path divergent from a circular path during rotation about said central axis.

16. The revolving door according to claim 15, and further including guide means for guiding said outer edge of said door wings, said guide means causing said outer edge to describe a path having straight sections which are parallel to one another.

17. The revolving door according to claim 16, wherein said guide means includes guide rollers movably engaged with a guide track.

18. The revolving door according to claim 16, wherein said guide means comprises a control and drive mechanism.

19. The revolving door according to claim 18, wherein said drive mechanism includes a drive belt-type revolving tension device which engages said door wings and causes retraction and extension movement of each sliding door element with respect to each other.

20. A revolving door, comprising:

a central axis of rotation;

at least four variable length door means extending radially into a passageway towards said central axis of rotation, each door means including at least two sliding door elements slidingly movable relative to each other to vary the radial extension of said door elements into said passageway, said door means being positionable in an operating position wherein said sliding door elements extend radially into said passageway;

each door means including a pivot axis disposed radially outwardly from said central axis;

each door means being pivotable about said pivot axis from said operating position to an open position in which said sliding door elements slide relative to each other to adjust said radial extension and create an opening in said passageway.

* * * * *